US008992351B2

(12) United States Patent
Manou

(10) Patent No.: US 8,992,351 B2
(45) Date of Patent: Mar. 31, 2015

(54) GOLF CLUB SHOE DEVICE

(75) Inventor: Nicholas D. Manou, Webster, NY (US)

(73) Assignee: Daniel Manou, Webster, NY (US)

( * ) Notice: Subject to any disclaimer, the term of this patent is extended or adjusted under 35 U.S.C. 154(b) by 134 days.

(21) Appl. No.: 13/620,950

(22) Filed: Sep. 15, 2012

(65) Prior Publication Data

US 2013/0072317 A1 Mar. 21, 2013

Related U.S. Application Data

(60) Provisional application No. 61/535,598, filed on Sep. 16, 2011.

(51) Int. Cl.

| | |
|---|---|
| ***A63B 57/00*** | (2006.01) |
| ***A43B 5/00*** | (2006.01) |
| ***A43C 19/00*** | (2006.01) |
| ***A63B 53/00*** | (2006.01) |
| ***A63B 53/04*** | (2006.01) |
| ***A63B 59/00*** | (2006.01) |
| ***A63B 71/00*** | (2006.01) |
| *A63B 55/00* | (2006.01) |
| *A63B 55/10* | (2006.01) |

(52) U.S. Cl.

CPC ..... *A63B 71/0009* (2013.01); *A43B 5/001* (2013.01); *A43C 19/00* (2013.01); *A63B 53/00* (2013.01); *A63B 53/04* (2013.01); *A63B 55/00* (2013.01); *A63B 55/008* (2013.01); *A63B 55/10* (2013.01); *A63B 59/007* (2013.01); *A63B 71/0045* (2013.01); *A63B 2208/0209* (2013.01); *A63B 2209/08* (2013.01); *A63B 2210/50* (2013.01)

USPC ..... 473/518; 473/217; 36/127; 36/133

(58) Field of Classification Search

USPC ..... 473/282, 324, 288, 287, 217, 412, 518; 36/127, 133, 72 R, 128, 113, 77 R, 107

See application file for complete search history.

(56) References Cited

U.S. PATENT DOCUMENTS

| | | | | | |
|---|---|---|---|---|---|
| 1,221,985 | A | * | 4/1917 | Golden | 36/128 |
| 1,637,278 | A | * | 7/1927 | Renz | 124/5 |
| 1,684,442 | A | * | 9/1928 | Haney | 36/8.3 |
| 1,726,198 | A | * | 8/1929 | Stahl | 36/128 |
| 2,220,291 | A | * | 11/1940 | Savoy | 473/217 |
| 2,269,357 | A | * | 1/1942 | Dent | 473/412 |
| 2,782,531 | A | * | 2/1957 | Frazier et al. | 36/133 |

(Continued)

FOREIGN PATENT DOCUMENTS

| | | |
|---|---|---|
| FR | 2785156 | 5/2000 |

*Primary Examiner* — Stephen L. Blau

(74) *Attorney, Agent, or Firm* — Woods Oviatt Gilman LLP; Katherine H. McGuire, Esq.

(57) ABSTRACT

A golf ball kicking device having hands-free interchangeability of golf club heads comprising a mounting plate secured to the shoe and a retaining member affixed to the mounting plate and having a pivoting lever with a release member in communication with a rear face of a club head. The mounting plate has a magnet and the rear face of the club head is constructed of a magnetic material so as to releasably mount the club head onto the mounting plate. When the club head is secured against the magnet, the club head impacts upon the release member so as to pivot the pivoting lever to a first position. When sufficient force is applied to the pivoting lever, the pivoting lever pivots to a second position thereby directing the release member to impact upon the club head and dislodge the club head from the mounting plate.

8 Claims, 15 Drawing Sheets

(56) References Cited

U.S. PATENT DOCUMENTS

| | | | | | |
|---|---|---|---|---|---|
| 2,881,539 | A * | 4/1959 | Dysart | 36/72 R |
| 3,406,469 | A * | 10/1968 | Dani | 36/133 |
| 3,851,410 | A * | 12/1974 | Frazier | 36/133 |
| 4,507,881 | A | 4/1985 | Fossa | |
| 5,080,371 | A * | 1/1992 | Karczewski | 473/510 |
| 5,301,442 | A * | 4/1994 | Williams | 36/127 |
| 5,472,200 | A * | 12/1995 | Miller | 473/217 |
| 5,651,742 | A * | 7/1997 | Dickson | 473/217 |
| 6,383,098 | B1 * | 5/2002 | Haumschilt et al. | 473/518 |
| RE37,887 | E | 10/2002 | Yates | |
| 6,886,275 | B1 * | 5/2005 | Westfall | 36/133 |
| 7,941,943 | B2 | 5/2011 | Baker et al. | |
| 2010/0056290 | A1 * | 3/2010 | Smith | 473/288 |

* cited by examiner

GOLF CLUB SHOE DEVICE

CROSS REFERENCE TO RELATED APPLICATIONS

This application claims the benefit of U.S. Provisional Application No. 61/535,598, filed Sep. 16, 2011, which is incorporated herein by reference in its entirety.

FIELD OF THE INVENTION

The present invention relates to golfing and golf devices and, more particularly, to embodiments of footwear configured to strike and propel a golf ball.

BACKGROUND OF THE INVENTION

Golf traditionally requires individuals to use a club or other striking implement to propel a golf ball towards a hole. Conventional golf clubs have an elongated shaft on which a club head is positioned. The club head has a face that impacts the ball as the shaft is swung by the golfer. Variations in the face and the shaft can change the parameters of the golf ball travel (e.g., the distance, loft or height, spin, etc.).

Unfortunately, some people are unable to manipulate a golf club to perform a proper swing of the club and shaft to controllably direct the flight of the golf ball. For example, disabilities, old age, injuries and other factors may prevent certain individuals (such as military veterans or those confined to a wheel chair) from gripping, lifting and/or swinging the club. These factors can foreclose these individuals from participation in the sport altogether. To alleviate these issues, and to allow individuals with certain impairments the ability to enjoy the game of golf, alternatives to the traditional golf club are needed. Indeed, some people may retain sufficient strength and coordination in their legs and feet so as to permit them to kick or otherwise strike a golf ball using their feet. Thus, these individuals may enjoy the experience of golf without the need for clubs.

As such, there is a need for a device that enables and encourages the enjoyment of the game of golf for individuals who are unable to swing a traditional golf club by providing for a shoe-based device wherein wearers strike the golf ball with their feet. Additionally, there is a need for a device that provides for interchangeability of various striking heads mounted onto the foot. Further, there is a need for striking head interchangeability which is hands-free and is completed solely by using one's feet. The present invention addresses these and other needs.

BRIEF SUMMARY OF THE INVENTION

The present disclosure describes, in various embodiments, footwear and related implements that permit individuals to propel golf balls via motion of their legs (e.g., kicking motion). In one embodiment, the device comprises a mounting plate having a retaining member disposed on an article of footwear and a club head that is releasably secured to the retaining member. More particularly, examples of the retaining member require little interaction from the end user to remove and replace the club heads on the footwear. In certain embodiments, the retaining member provides an effectively "hands-free" solution in which the end user can remove and secure the club heads onto the mounting plate without (or with very limited) use of the hands.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

Where applicable like reference characters designate identical or corresponding components and units throughout the several views, which are not to scale unless otherwise indicated.

DETAILED DESCRIPTION OF THE INVENTION

Figure 1:
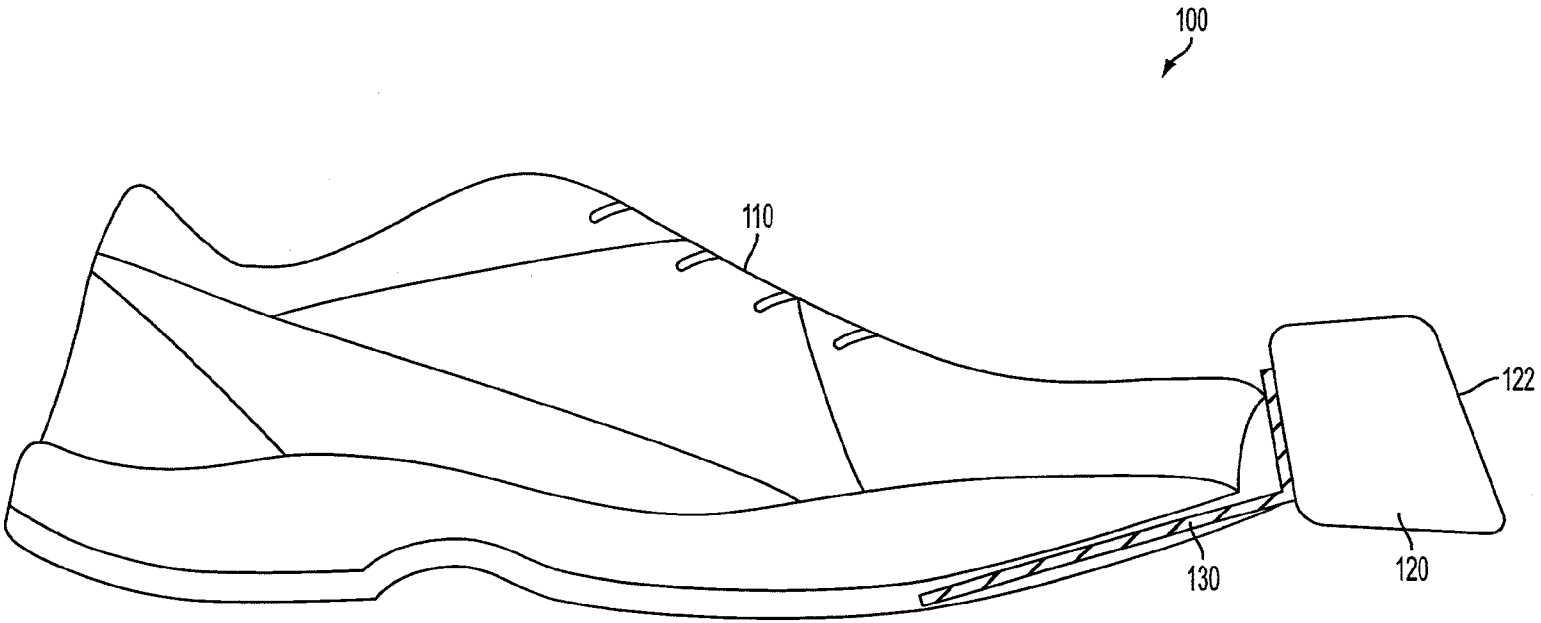
FIG. 1 is a side view of a device for propelling a golf ball according to a first embodiment of the present invention.

Referring to the drawings in detail, and specifically to FIG. 1, a side view shows an exemplary embodiment of a device 100 that can be used to propel a golf ball. The device 100 is adapted to be worn on a footwear 110 (or "shoe 110") and can include a club head 120 and a mounting plate (or bracket) 130 and/or another configuration that stabilizes the club head 120 on the footwear 110 at impact with the golf ball. The club head 120 includes a club face 122, with the device including one or more of a series of club heads having varying degrees of loft to generate different trajectories of the golf ball during flight. In preferred embodiments, a retaining member, having a first element disposed on the club head 120, and a second element disposed on the footwear 110 or mounting plate 130, mates together to secure the club head 120 to the footwear 110.

Examples of the footwear 110 include golf shoes, as well as other shoes and sneakers including athletic style shoes (e.g., running shoes). The footwear 110 can include spikes (not shown) that protrude from the underside of the footwear 110, although certain configurations of the footwear 110 may be devoid of all or some spikes so as to reduce drag with the ground during a kicking motion. In one example, spikes may be used on only one of the pieces of footwear and, more particularly, the piece of footwear that is not used to strike the golf ball. Construction of the footwear 110 may utilize a variety of known materials such as leather, fabric and the like. The footwear 110 may incorporate the mounting plate 130. For example, portions of the footwear 110 may integrate the mounting plate 130 to hide the mounting plate 130 from sight. In other examples, the mounting plate 130 secures to the sole of the footwear 110. Further examples secure the mounting plate to the top of the footwear through use of the shoe's laces or straps. These configurations may benefit embodiments of the device 100 that retrofit existing shoes, thereby preparing the shoes to receive the club head 120 thereon.

Additionally, the mounting plate 130 may support a portion of the retaining member. However, this disclosure also contemplates configurations in which footwear 110 incorporates the second element (and/or the retaining member) directly, for instance, onto the toe of the footwear 110. Examples of the mounting plate 130 can comprise stainless steel or other materials of high strength and stiffness, such as composites, plastics or other metals (e.g., aluminum) which have properties suitable for use herein.

The retaining member forms an interface to permit releasable engagement of the footwear 110 and the club head 120. Operating this interface may not require the use of tools, let alone the hands, feet or extremities of the end user. For example, the first element and the second element can have features that lock and unlock with one another by manipulation (e.g., twisting, turning, screwing, snapping, etc.) or through non-manipulative coupling such as through magnetic interactions between the footwear 110 and the club head 120. Although not necessarily shown, the interface may include various intermediary pieces, such as plates, blocks and the like, which facilitate secure connection of the footwear 110 to the club head 120.

Figure 2A:
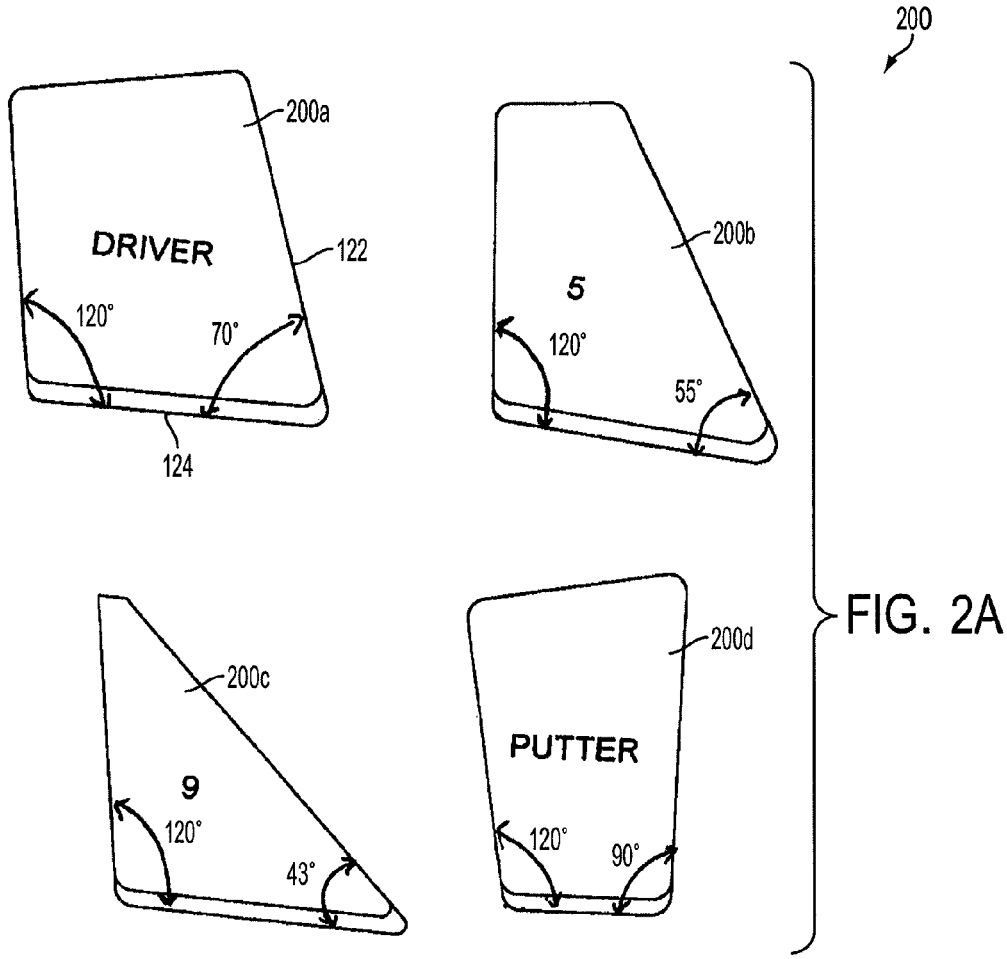
FIG. 2A shows side views of representative club heads used in a device for propelling a golf bail.
Figure 2B:
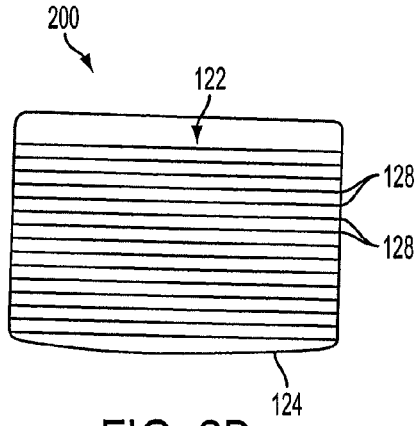
FIG. 2B is a front view of an exemplary club head used in a device for propelling a golf ball.

Turning now to FIGS. 2A and 2B, examples of various club heads for use with the present device are generally indicated by reference numeral 200. While a limited selection of club heads is referenced by numeral 200, it is envisioned that club heads used with the device of the present invention have similar features as generally available golf clubs, such as drivers, fairway woods, irons, wedges, putters, hybrids and rescue clubs. Referring now to FIG. 2A specifically, side views of examples of club heads include a driver (200*a*), a five wood (200*b*), a nine wood (200*c*) and a putter (200*d*). As seen by the side view, and using driver 200*a* as an example, each club has a bottom edge 124 which, when viewed from the side, is parallel to a horizontal plane created by the ground when the golf ball is impacted by the club head. A rear face 126 has an angle of generally about 120 degrees (120°) between the horizontal plane and the bottom edge 124. This angle assists in positioning the club head flush to the external "toe" surface of footwear 110. A flush fit improves the consistency and quality of the strikes as the user has improved control, and the foot and footwear impart maximum kinetic energy to the ball upon impact. Although an angle of 120° is preferred, it is within the scope of this invention to have club heads with additional varying angles depending upon the footwear associated with the device.

Each club also has a club face 122 at an angle relative to the horizontal plane created by the bottom edge 124. By way of example, driver 200*a* has a club face 222*a* having an angle of approximately 70°, while five wood 200*b* has an angle of approximately 55°, nine wood 200*c* with an angle of approximately 43° and a putter 200*d* with an angle of approximately 90°. Generally, as the degree of the angle decreases, the struck ball will have a higher loft trajectory and shorter distance of travel. For instance, assuming each strike is equal, a ball struck by the driver (70°) will have a flatter, lower trajectory but travel a farther distance than a ball struck by the five wood (55°) or nine wood (43°). In this way, a user can control the height and distance of each shot by selecting an appropriate club head having the desired performance characteristics.

An exemplary front view of any one of club heads 200 is shown in FIG. 2B. As can be seen in FIG. 2B, bottom edge 124 of the club head has a convex profile when viewed from the front yielding a club head with a curved lower surface. The curved surface allows the user to contact the ground with a smaller impacted surface area (i.e. at the apex of the curve rather than the entire lower surface). This reduced impact permits the user to impart more of the energy generated by the kick to the ball (making it fly farther) rather than wasting energy by transferring it to the ground at impact. Additionally shown in FIG. 2B, all or a portion of club heads 200 may further by configured with one or more shallow horizontal grooves 128 traversing across the club face 122. These grooves provide the ability for the user to impart spin on the ball on impact. This spin can change the trajectory of the ball while in flight or upon contacting the ground after flight. For instance, a user may impart back spin on the ball to cause it to stop where it lands or even roll backwards from where it lands rather than bounce or roll forward. In addition to the club face 122, the club heads 120 may include a body portion that includes the respective part of the retaining member. Each club head 120 may be constructed of any suitable materials including cast metal and/or other lightweight materials, such as plastics and composites, to reduce the weight of the club head 120.

Figure 3B:
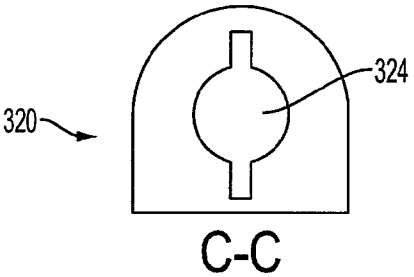
FIG. 3B illustrates a corresponding club head for use with the device of the first embodiment of the present invention shown on FIG. 3A.
Figure 3B:
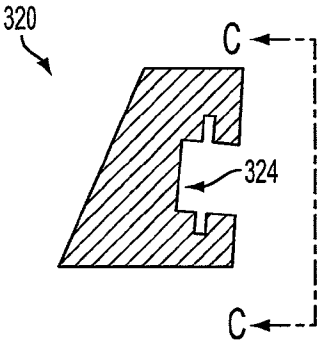
Figure 3A:
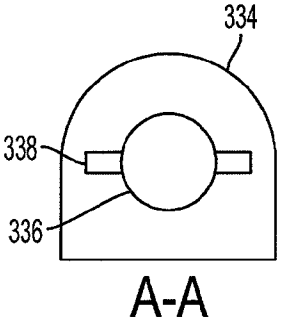
FIG. 3A illustrates a first mounting plate for use with the device of the first embodiment of the present invention shown on FIG. 1.
Figure 3A:
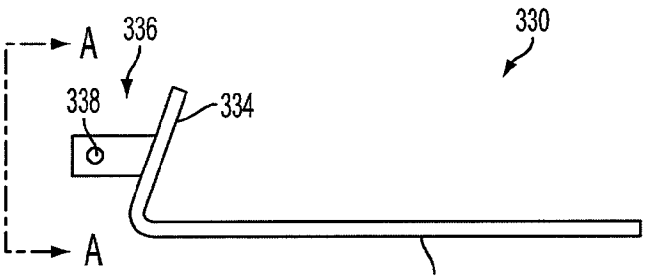

Adverting now to FIGS. 3A and 3B, an example of a mounting plate 330 (e.g., the mounting plate 130 of FIG. 1) and a club head 320 (e.g., the club head 120 of FIG. 1) of one embodiment of a device for propelling a golf ball according to the present invention is shown. In this example, the mounting plate 330 includes an elongated base 332 and an upright portion 334. The first element of the retaining member includes a boss 336 which extends from the upright portion 334. On the boss 336, one or more locking members 338 protrude radially outward away from the surface of the boss 336. The club head 320 includes a receptacle 324 (the second element of the retaining member), which can receive the boss 336 and the locking member(s) 338 therein. When implemented on footwear (e.g., footwear 110 of FIG. 1), the elongated base 332 extends into the body of the footwear, such as into the sole and below where the bottom of the foot rests. The upright portion 334 sits at the toe portion of the footwear thereby position the boss 336 to protrude from the toe portion and away from the footwear. The club head 320 is positioned to align the receptacle 324 with the boss 336. Sliding the boss 336 into the receptacle 324 and, in one example, rotating the club head 320 will effectively secure the club head 320 to the mounting plate 330.

Figure 4A:
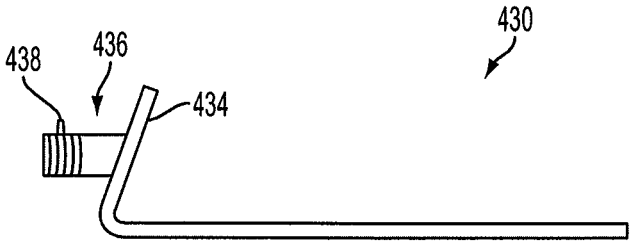
FIG. 4A illustrates a second mounting plate for use with the device of the first embodiment of the present invention shown on FIG. 1.
Figure 4B:
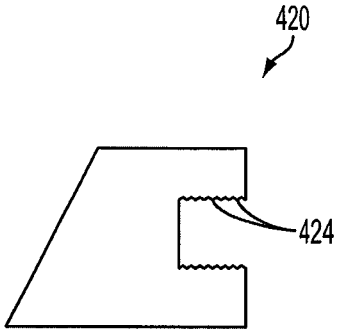
FIG. 4B illustrates a second corresponding club head for use with the device of the first embodiment of the present invention shown on FIG. 4A.

Turning now to FIGS. 4A and 4B, an alternative embodiment of a device for propelling a golf ball according to the present invention comprises a mounting plate 430 and a club head 420. A boss 436 extends outwardly from the upright portion 434 of mounting plate 430 and is configured with one or more threads 438 (the first element of the retaining member). The club head 420 includes corresponding interlocking threads 424 (the second element of the retaining member), which can receive the boss 436 and the thread(s) 438 therein. Rotating the threaded connector of the club head 420 onto threads 438 effectively secures the club head 420 to the mounting plate.

Figure 5A:
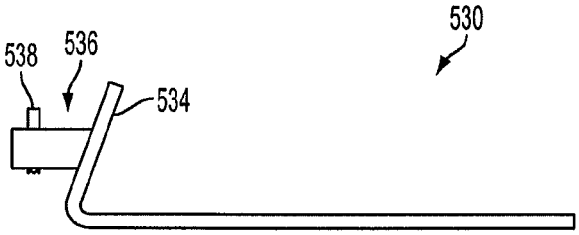
FIG. 5A illustrates a third mounting plate for use with the device of the first embodiment of the present invention shown on FIG. 1.
Figure 5B:
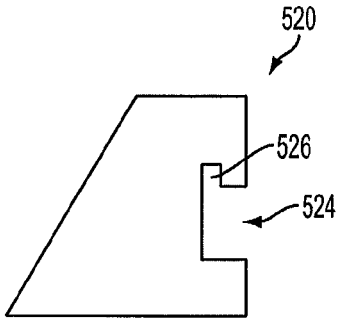
FIG. 5B shows a side view of a third corresponding club head for use with the device of the first embodiment of the present invention shown on FIG. 5A.
Figure 5C:
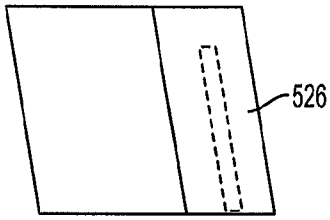
FIG. 5C illustrates a top view of a third mounting plate and corresponding club head for use with the device of the first embodiment of the present invention shown on FIG. 1.

With reference to FIGS. 5A and 5C, an additional embodiment of a device for propelling a golf ball according to the present invention comprises a mounting plate 530 and a club head 520. A boss 536 extends outwardly from the upright portion 534 of mounting plate 530 and is configured with a locking member 538 protruding radially outward away from the surface of the boss 536 (the first element of the retaining member). The club head 520 includes corresponding receptacle 524 which includes a slot 526 (the second element of the retaining member) to receive a portion of the boss 536. To mount the club head 520 onto the mounting plate 530, the receptacle 524 slides along the boss 536 relative to the mounting plate 530. Although not shown, one or more of the boss 536 and the receptacle 524 may include additional features that interlock or snap together to secure the club head 520 to the mounting plate 530. Various concepts can be used to secure the two components together, including but not limited to friction, pressure, spring force and magnetic force.

Figure 6A:
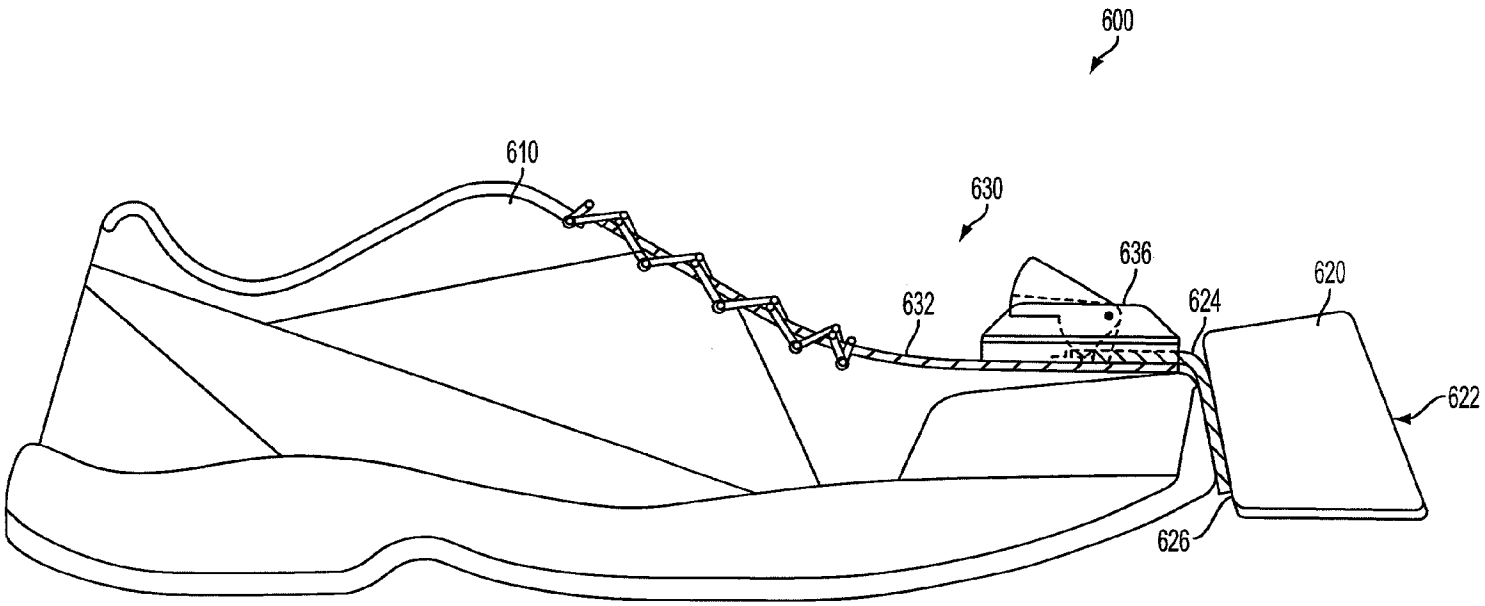
FIG. 6A is a side view of a device for propelling a golf ball according to a second embodiment of the present invention.
Figure 6B:
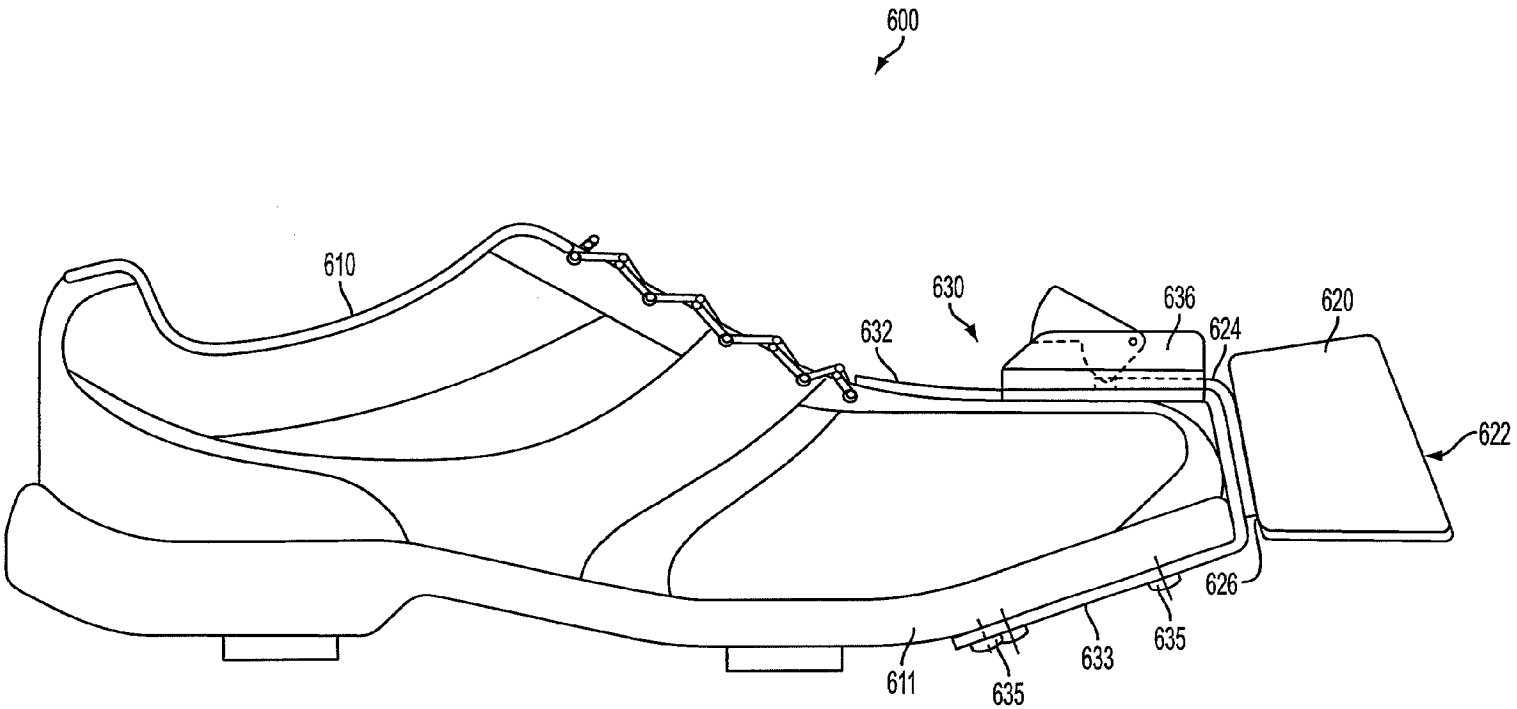
FIG. 6B is a side view of a device for propelling a golf ball according to yet another embodiment of the present invention.

FIGS. 6A and 6B show alternative embodiments of a device 600 that can used to propel a golf ball. The device 600 is adapted to be worn on a footwear 610 and can include a club head 620 and a mounting plate (or bracket) 630 and/or other configuration that stabilizes the club head 620 on the footwear 610 at impact with the golf ball. As shown in this embodiment, mounting plate 630 comprises a retaining member 636 affixed to a tongue plate 632. Club head 620 has a club face 622 and a rear face 626. Secured to the rear face 626 is a support 624. Support 624 has a generally L-shaped side profile and is adapted to slide into and be releasably secured within retaining member 636 (as discussed in greater detail with regard to FIGS. 8A and 8B, below). In this embodiment, mounting plate 630 may be secured to the top surface of footwear 610 by any suitable means, for example, by lacing the shoe laces about the plate as described with reference to FIGS. 7A-7C below. The club head 620 is releasably attached to the retaining member, and by extension to the shoe, such that a kicking motion of the foot will cause the club head to strike a golf ball and propel the ball in a forward direction.

FIG. 6B shows an alternate embodiment wherein the bracket includes a sole piece 633 that extends around the toe of the shoe and along the forward segment of the shoe sole 611. Holes are provided therein which align with the existing cleat pattern of the golf shoe. Removal of the cleats at the location of the bracket holes allows a respective securing member 635 to be passed therethrough for securing the bracket to the shoe.

Figure 7A:
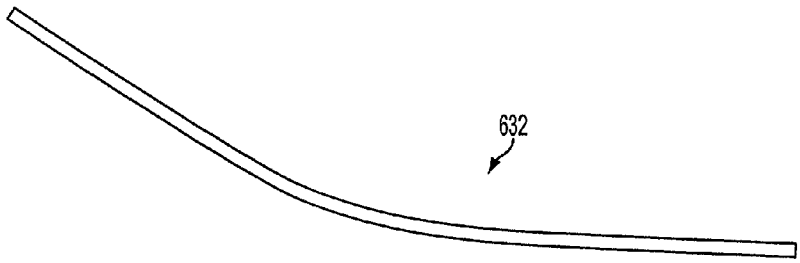
FIG. 7A is a side view of a tongue plate for use with the device of the second embodiment of the present invention shown on FIG. 6.
Figure 7B:
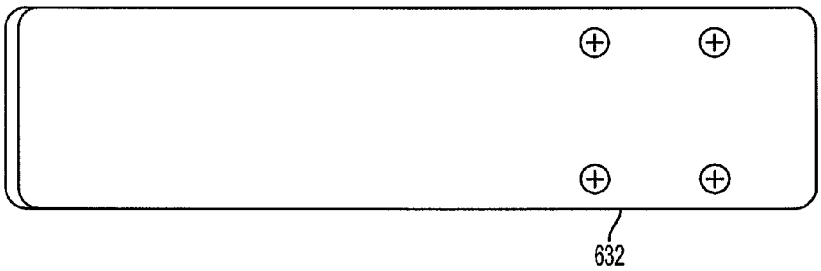
FIG. 7B is a top view of a first embodiment of a tongue plate for use with the device of the second embodiment of the present invention shown on FIG. 6.
Figure 7C:
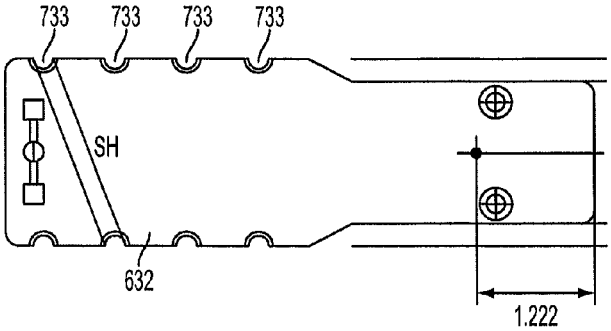
FIG. 7C is a top view of a second embodiment of a tongue plate for use with the device of the second embodiment of the present invention shown on FIG. 6.

As shown in FIGS. 7A through 7C, tongue plate 632 of mounting plate 630 is a generally flat member having a curved profile. Tongue plate 632 is a rigid yet flexible member having a first end worn generally along the "tongue" portion of a shoe and a second end resting proximate the "toe" portion of a shoe, where the second end is adapted to securely affix a retaining member 636 (as shown in FIG. 6) Tongue plate 632 is rigid enough such that it can securely mount retaining member 636 and withstand the repeated forces exerted on the retaining member through multiple impacts with the golf ball, while also being flexible enough to be worn on a variety of styles or brands of footwear and at the same time ensuring wearer comfort when worn on top of the foot. Tongue plate 632 can be a simple rectangular member (FIG. 7B) or be adapted to include one or more scalloped recesses 733 about which shoe laces can be passed so as to provide additional security by preventing or minimizing side-to-side shifting of the mounting plate when worn on the footwear. Tongue plate 632 may be constructed of any suitable material possessing the performance characteristics described above, including but not limited to a thin metal such as stainless steel, steel or aluminum, or a composite, plastic or other suitable polymeric material.

Figure 8A:
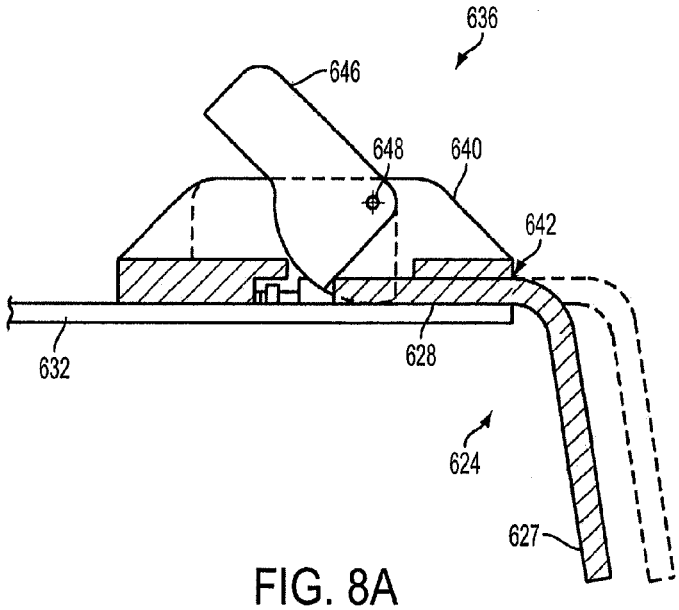
FIG. 8A is a side view of a first embodiment of a retaining member for use with the device of the second embodiment of the present invention shown on FIG. 6.
Figure 8B:
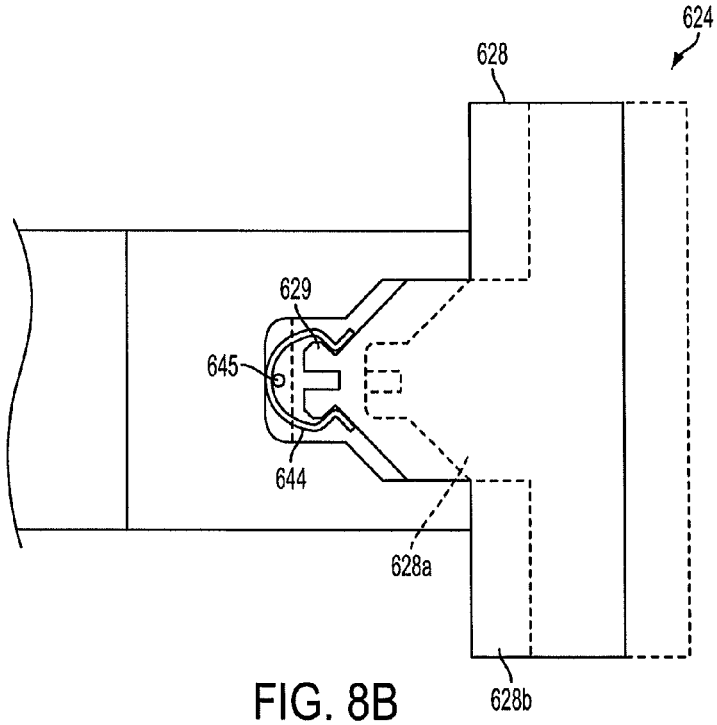
FIG. 8B is a top view of a first embodiment of a retaining member for use with the device of the second embodiment of the present invention shown on FIG. 6.

FIGS. 8A and 8B provide a more detailed view of a retaining member 636 (and associated environs) used in one embodiment of the present invention. Retaining member 636 is fixedly attached to tongue plate 632 so as to create a horizontal recess 642 between the two. Tongue plate 632 and retaining member 636 are ideally positioned on the shoe such that the open end of the horizontal recess 642 rests generally at the outer edge of the toe end of the footwear. Support 624 (mounted to club head 620, not shown) has a generally L-shaped side profile comprising a generally vertical member 627 and a generally horizontal member 628. Horizontal member 628 is proportioned so as to slidably fit within horizontal recess 642. As shown in FIG. 7B, horizontal member 628 is generally T-shaped so that the narrow upright portion 628*a* slides within the recess while the wider transverse 628*b* transitions into the vertical member 627 and provides increased surface on the support 624 for mounting the club head. As further shown in FIG. 7B, the closed end of the horizontal recess 642 may be equipped with a fastener 644. In a preferred embodiment, fastener 644 is a generally c-shaped spring clip secured in place using a pin 645. Alternatively, retaining member 636 may be manufactured such that the spring clip is held in place through a specifically dimensioned enclosure within the retaining member. Upright portion 628*a* of support 624 has a corresponding fastener prongs 629 which engages with the spring clip and releasably attaches the club head (via support 624) to the footwear (via mounting plate 630).

In a preferred embodiment, release of support 624 from retaining member 636 is through a pivoting lever 646. Pivoting lever 646 is mounted onto retaining member 636 so that when the support mounted onto a club head is inserted within the horizontal recess 642, pivoting lever 646 moves generally upwardly about pivot pin 648. To release the support 624, a downward force (for instance by pushing with a hand or a foot) is applied to the lever 646 such that it pivots downwardly about pin 648 thereby dislodging fastener prongs 629 on support 624 from spring clip fastener 644 within retaining member 636, thus allowing horizontal member 628 to slide out of the horizontal recess 642. A user may then change club heads in a hands-free manner by simply sliding the support of a newly selected club head within the horizontal recess until the fastener on the support is properly seated within the clip on the retaining member.

Figure 9:
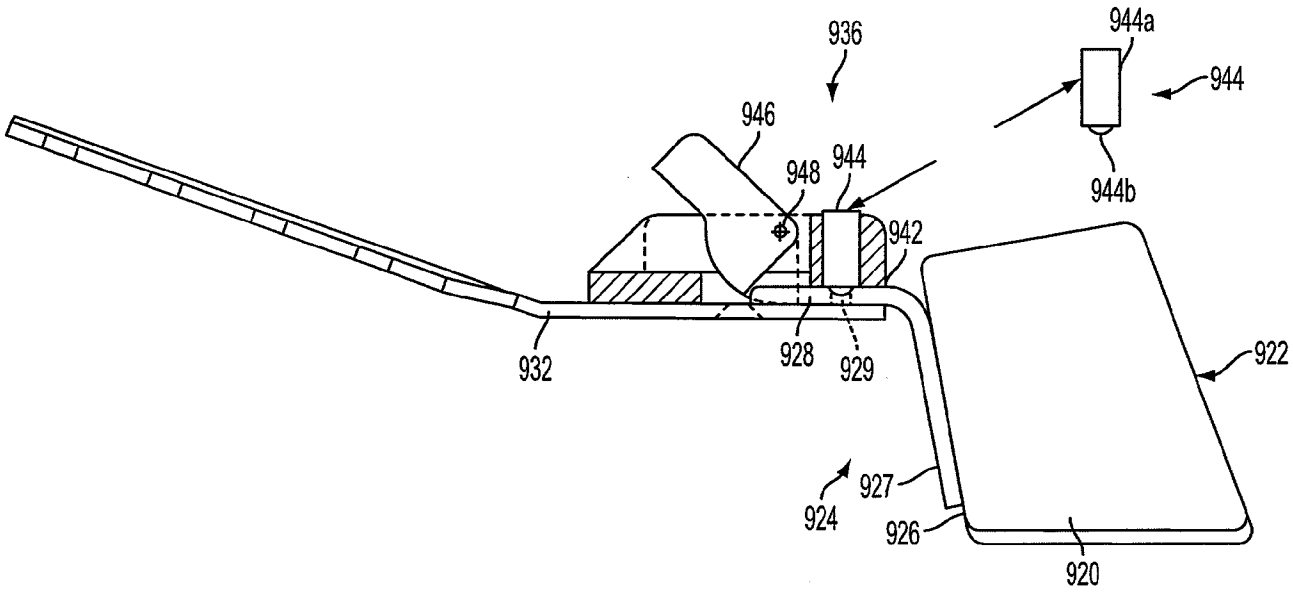
FIG. 9 is a side view of a second embodiment of a retaining member for use with the device of the second embodiment of the present invention shown on FIG. 6.

Turning now to FIG. 9, a more detailed view of a retaining member 936 (and associated environs) used in a further embodiment of the present invention is shown. In this embodiment, retaining member 936 is fixedly attached to tongue plate 932 so as to create a horizontal recess 942 between the two. Tongue plate 932 and retaining member 936 are ideally positioned on the shoe such that the open end of the horizontal recess 942 rests generally at the outer edge of the toe end of the footwear. Support 924, mounted to club head 920, has a generally L-shaped side profile having a generally vertical member 927 and a generally horizontal member 928. Horizontal member 928 is proportioned so as to slidably fit within horizontal recess 942.

Similar to horizontal member 628 described above with reference to FIGS. 8A and 8B, horizontal member 928 is generally T-shaped so that the narrow upright portion slides within the recess while the wider transverse transitions into the vertical member 927 and provides increased surface on the support for mounting the club head. Horizontal member 928 is adapted to have a chamfered recess 929 which corresponds to and engages a spring plunger 944 mounted within retaining member 936. Spring plunger 944 is comprised of a body portion 944*a* in which a spring loaded ball bearing 944*b* is housed. Thus, as horizontal member 928 is inserted with the horizontal recess 942, ball bearing 944*b* is pressed into body portion 944*a* until such time as chamfered recess 929 is in vertical alignment with the downward force exerted by the spring within the plunger 944. Once the chamfered recess 929 is in alignment, the stored spring force of the spring within the body portion 944*a* pushes ball bearing 944*b* partially out of the body portion 944*a* to rest within the recess 929 thereby releasably securing support 924 within retaining member 936.

In a preferred embodiment, release of support 924 from retaining member 936 is through a pivoting lever 946. Pivoting lever 946 is mounted onto retaining member 936 so that when the support mounted onto a club head is inserted within the horizontal recess 942, pivoting lever 946 moves generally upwardly about pivot pin 948. To release the support 924, a downward force (for instance by pushing with a hand or a foot) is applied to the lever 946 such that it pivots downwardly about pin 948 thereby providing a generally upward force on ball bearing 994*b* via the distal end of horizontal member 928. With application of sufficient upward force by the horizontal member, the downwardly applied spring force applied by a spring within body portion 944*a* is overcome causing the ball bearing to enter the body portion 944, and thus freeing horizontal member 928 so that it may slide out of the horizontal recess 942. Thus, a user may then change club heads in a hands-free manner by simply sliding the support of a newly selected club head within the horizontal recess until the support is properly seated within the recess and retained by the ball bearing.

Figure 10:
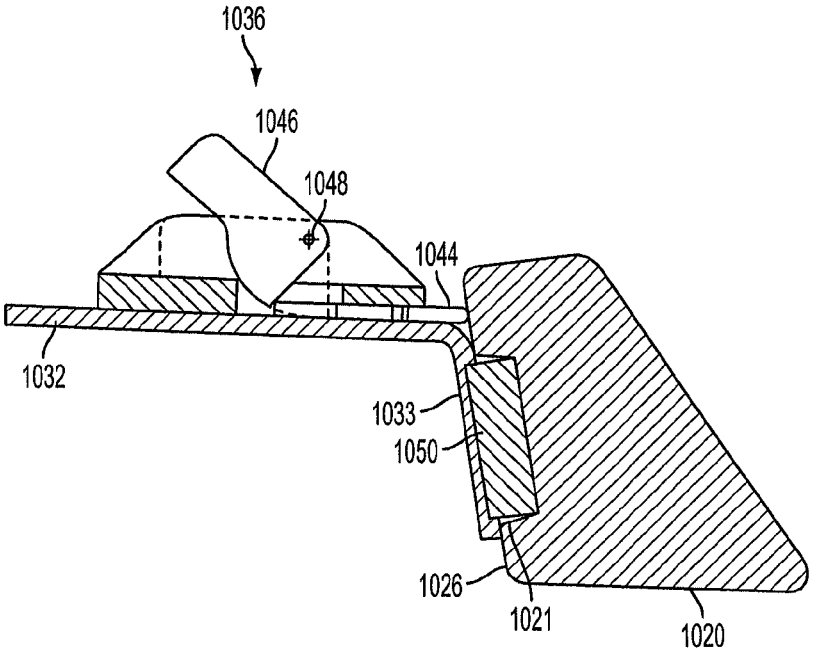
FIG. 10 is a side view of a third embodiment of a retaining member, with a modified tongue plate, for use with the device of the second embodiment of the present invention shown on FIG. 6A.

Adverting now to FIG. 10, a more detailed view of a retaining member 1036 (and associated environs) used in an alternative embodiment of the present invention is provided. In this embodiment, retaining member 1036 is fixedly attached to tongue plate 1032 so as to create a horizontal recess 942 between the two. Tongue plate 932 and retaining member 936 are ideally positioned on the shoe such that the open end of the horizontal recess 942 rests generally at the outer edge of the toe end of the footwear. Tongue plate 1032 is further adapted to have a generally downwardly extending support 1033. In one embodiment of the device shown in FIG. 10, extending support 1033 has a magnet 1050 fixedly attached to the outwardly directed face of the support. Club head 1020, having a rear face 1026 with an incorporated recess 1021, is releasably secured to the support 1033 by aligning recess 1021 with the outwardly projecting magnet 1050. In this embodiment, all or at least the portion immediately surrounding recess 1021 of club head 1020 is comprised of magnetic material so as to be attracted to, and be bound by, magnet 1050. While this embodiment is preferred as requiring only one magnet, alternative embodiments may have individual club heads fixedly mounted with magnets on their rear faces with these magnets being attracted to a magnetic downwardly extending support of the tongue plate. Additionally, while the magnet is shown and described as extending outwardly from the extending support 1033 and engaged within recess 1021, it is envisioned that the magnet may be flush with exterior surface of the support with the recess within rear face of the club head removed such that the magnet and rear face interact without additional physical lateral restraints (i.e. side walls of recess 1021). Further, while described as a single magnet, additional embodiments envision the use of two or more magnets or a magnet or magnets of various sizes or shapes so long as the recess or recesses on the rear face of the club head conform with these alternative designs so as to firmly yet releasably mount the club head on the footwear.

In a preferred embodiment, release of club head 1020 from extending support 1033 (and magnet 1050) is through a pivoting lever 1046. Pivoting lever 1046 is mounted onto retaining member 1036 so that when a club head is mounted onto magnet 1050, pivoting lever 1046 moves generally upwardly about pivot pin 1048 through a rearwardly directed force applied by release member 1044. To release the club head 1020, a downward force (for instance by pushing with a hand or a foot) is applied to the lever 1046 such that it pivots downwardly about pin 1048 thereby providing a generally horizontal force to release member 1044. With sufficient force applied to the lever, the magnetic interaction between magnet 1050 and club head 1020 is overcome thereby releasing the club head 1020 from the device. A user may then change club heads in a hands-free manner by simply aligning the magnet on the footwear with the recess within the rear face of a newly selected club head.

Figure 11:
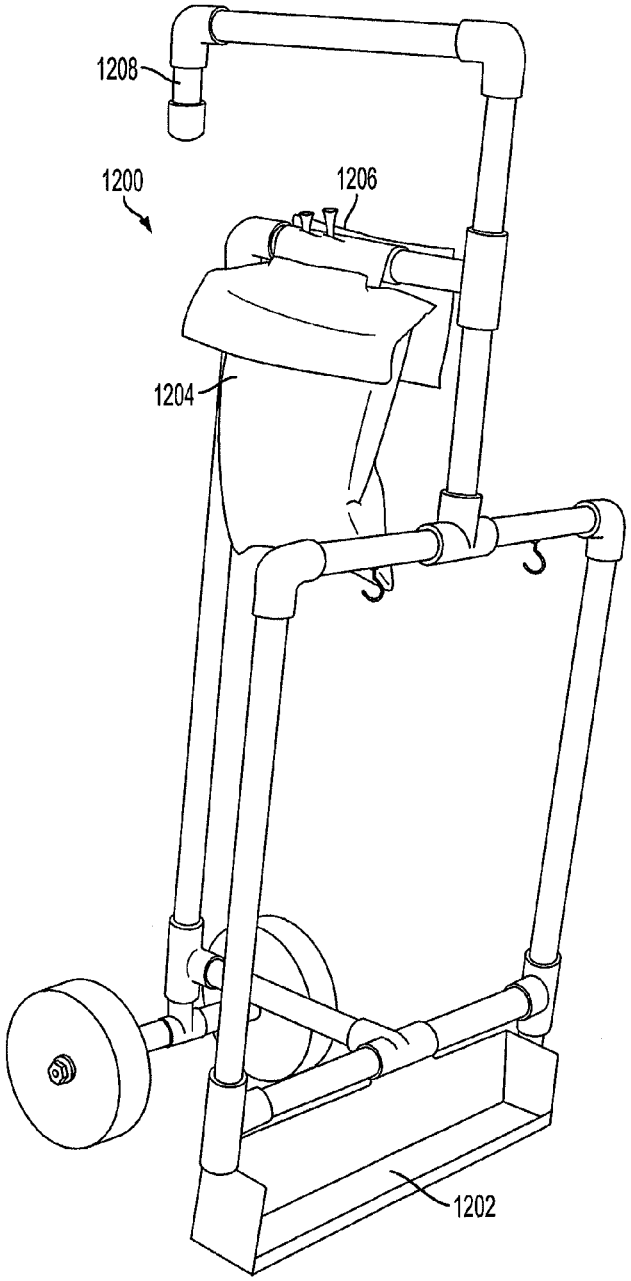
FIG. 11 is a perspective view of an embodiment of a cart for transporting and positioning the club heads for use on the course, in addition to other golf equipment, as desired.

FIG. 11 shows an embodiment of a golf cart 1200 that includes a platform 1202 which is configured to hold and transport the club heads (not shown in FIG. 11). It is seen that the platform 1202 lies close to the ground such that the golfer may face the platform and use the motion of their leg and respective foot to attach and detach the desired club head to and from their shoe in the manner described above, with or without the help of their hands, as desired. Other golf equipment such as balls and tees and the like may also be carried by cart 1200 in bags and holders such as seen at 1204 and 1206, for example, as desired. The cart may include a handle 1208 configured to be pulled by a strap (not shown) attached to the golfer's waist, for example, so as to free the hands while pulling the cart, if necessary. The cart may also be made as a remote controlled powered cart.

Figure 12A:
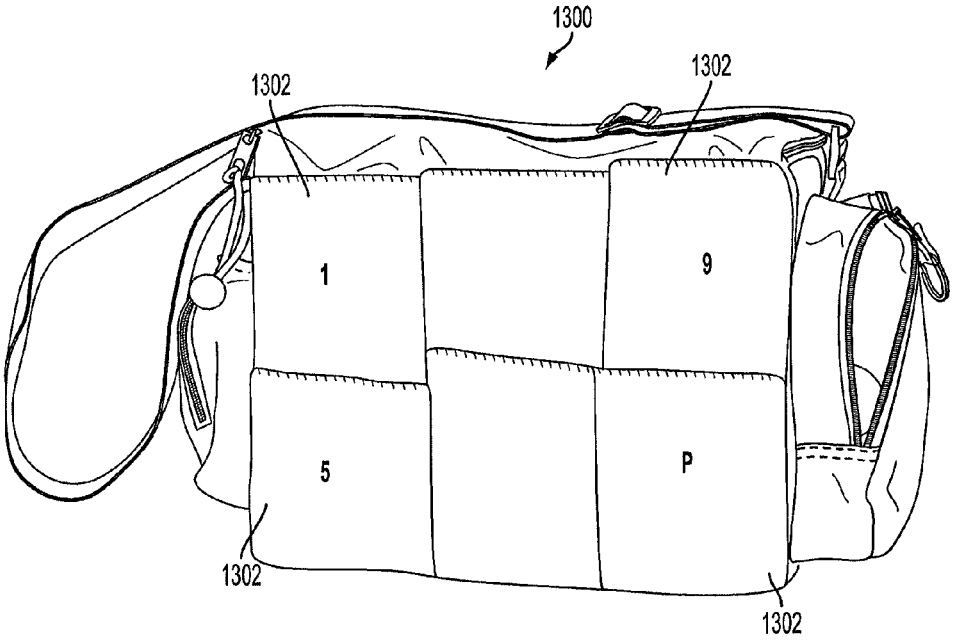
FIG. 12A is a side view of an embodiment of golf bag that is adapted to carry the club heads.
Figure 12B:
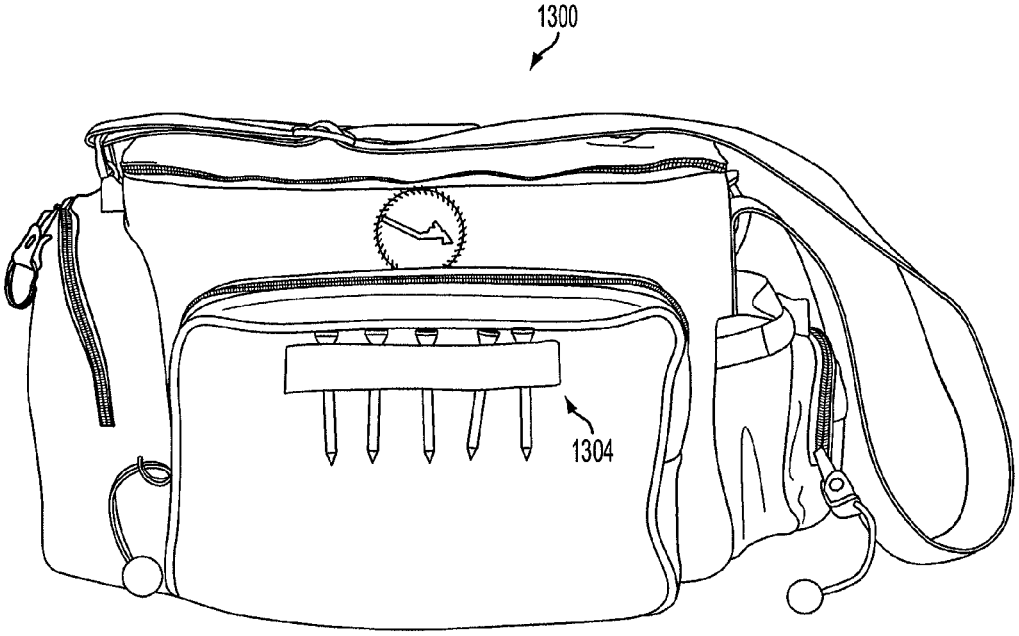
FIG. 12B is the opposite side view of FIG. 12A.

FIGS. 12A and 12B show an embodiment of golf bag 1300 that may hold the club heads in individual compartments 1302 located on the outside of the bag. The compartments may be visually marked as shown to indicate which club head is meant to be held within the respective compartment. If desired, holders for tees may be provided at the opposite side of the bag as indicated at 1304, for example, as seen in FIG. 12B.

Figure 13:
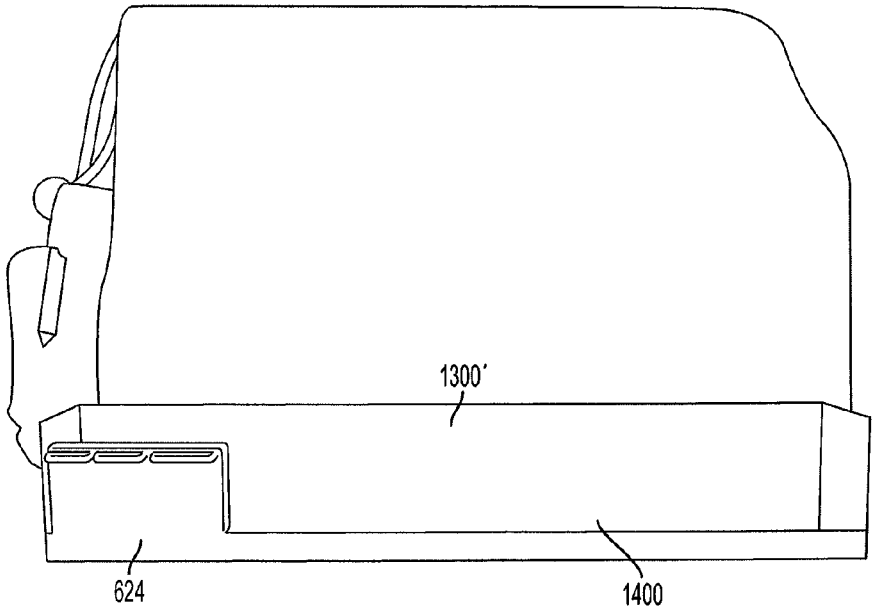
FIG. 13 is a side view of an alternate embodiment of a golf bag adapted to carry the club heads.

In an alternate embodiment, a golf bag 1300' may include a platform 1400 provided on the bag exterior as seen in FIG. 13 where the club heads may be positioned with support 624 facing the outside to allow hands-free alternate attachment and detachment of the club heads to the shoe as described above. The golfer simply places the bag on the ground and maneuvers the foot and golf shoe against the desired club head on the platform. In this instance, the club heads may be removably held in place on the platform via magnets.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A golf ball kicking device adapted to be worn on a shoe having hands-free interchangeability of golf club heads comprising:

a. a mounting plate adapted to be secured along an upper surface of the shoe;

b. a club head for striking the golf ball; and c. a retaining member securely affixed to the mounting plate and adapted to releasably secure the club head on the mounting plate in front of a toe portion of the shoe wherein the retaining member and the mounting plate form a recess proximate the toe portion of the shoe, and wherein the club head further comprises a support adapted to fit within the recess.

2. The device of claim 1 wherein the mounting plate comprises a tongue plate having a first end secured along a tongue of the shoe and a second end terminating proximate the toe portion of the shoe.

3. The device of claim 1 wherein the retaining member further comprises a first fastener and the support further comprises a second fastener wherein the first and second fasteners engage with one another to releasably secure the club head to the mounting plate.

4. The device of claim 3 wherein the first fastener is a spring clip and the second fastener is one or more prongs.

5. The device of claim 3 wherein the first fastener is a spring plunger and the second fastener is a recess within the support.

6. The device of claim 3 wherein the retaining member further comprises a pivoting lever in communication with the recess wherein, a. when the support is secured within the recess, the support impacts upon the pivoting lever so as to pivot the pivoting lever to a first position, and b. when a force sufficient to overcome the interaction between the first and second fasteners is applied to the pivoting lever in the first position, the pivoting lever pivots to a second position thereby impacting upon the support and sliding the support out of the recess.

7. The device of claim 1 wherein the retaining member further comprises a pivoting lever in communication with the recess wherein, a. when the support is secured within the recess, the support impacts upon the pivoting lever so as to pivot the pivoting lever to a first position, and b. when a force is applied to the pivoting lever in the first position, the pivoting lever pivots to a second position thereby impacting upon the support and sliding the support out of the recess.

8. The device of claim 1 wherein the mounting plate comprises a tongue plate having a first end secured along a tongue of the shoe and a second end extending over the toe portion of the shoe and terminating proximate a sole of the shoe.

* * * * *